United States Patent [19]

Buck

[11] 4,058,249

[45] Nov. 15, 1977

[54] STACKING TRAY

[75] Inventor: Stanley Edward Buck, Montreal, Canada

[73] Assignee: Domtar Limited, Montreal, Canada

[21] Appl. No.: 730,374

[22] Filed: Oct. 7, 1976

[51] Int. Cl.[2] ..... B65D 5/22

[52] U.S. Cl. ..... 229/34 HW; 229/DIG. 11

[58] Field of Search ..... 229/34, 34 HW, DIG. 11

[56] References Cited

U.S. PATENT DOCUMENTS

| | | | |
|---|---|---|---|
| 2,283,950 | 5/1942 | Ringler | 229/34 HW |
| 2,388,243 | 11/1945 | Arneson | 229/34 HW |
| 2,675,166 | 4/1954 | Main | 229/34 HW |
| 3,114,493 | 12/1963 | Dunkin | 229/DIG. 11 |

FOREIGN PATENT DOCUMENTS

| | | | |
|---|---|---|---|
| 1,439,175 | 4/1966 | France | 229/DIG. 11 |
| 1,456,917 | 9/1966 | France | 229/DIG. 11 |
| 188,322 | 3/1964 | Sweden | 229/DIG. 11 |

*Primary Examiner*—Davis T. Moorhead
*Attorney, Agent, or Firm*—C. A. Rowley

[57] ABSTRACT

A blank and a tray formed therefrom and having end walls each formed by a first end panel foldably connected to a bottom panel, a first top panel, a second top panel and a second end panel all foldably interconnected by a set of substantially parallel fold lines thereby to provide a multilayered vertical wall and a top platform of at least a double thickness. Preferably, a projecting nesting panel is formed in the second top wall and is connected directly to the second end panel, a slot is provided in the first top panel adjacent its connection with the first end panel and said nesting panel is projected through said slot when said blank is erected to form a tray.

4 Claims, 4 Drawing Figures

STACKING TRAY

The present invention relates to a tray, more specifically the present invention relates to a stacking and tray or crate for shipping fruit and the like.

It is known to make nesting and stackable trays from blanks of cardboard such as corrugated board and the like as examplified by Canadian Pat. Nos. 599,910 issued June 14th, 1960 to Crane; and 692,083 issued Aug. 4th 1964 to Johnson. Both of these patents require an added structural member to provide the nesting feature of the trays and neither provide a double thickness ledge along a pair of opposed walls to thereby form strong supporting structure for stacking the trays.

It is the object of the present invention to provide an improved stacking tray. More particularly the object of the present invention is to provide a stacking, nesting tray structure that is constructed substantially entirely from a single sheet of material.

Broadly the present invention, comprises a blank and a tray formed therefrom including a bottom panel, end walls, each said end wall formed by a first end panel foldably connected to said bottom panel, a first top panel, a second top panel and a second end panel foldably interconnected by a set of substantially parallel fold lines. Preferably, a projecting nesting panel is formed in said second top wall and is connected to said second end panel and a slot is provided in said first top panel adjacent its connection with said first end panel. Said nesting panel projects through said slot when the blank is connected to form a tray.

Further features, objects, and advantages of the invention will be evident from the following detailed description of the preferred embodiement of the present invention taken in conjunction with the accompanying drawings in which FIG. 1 is an isometric view of a tray constructed in accordance with the present invention.

Figure 2:
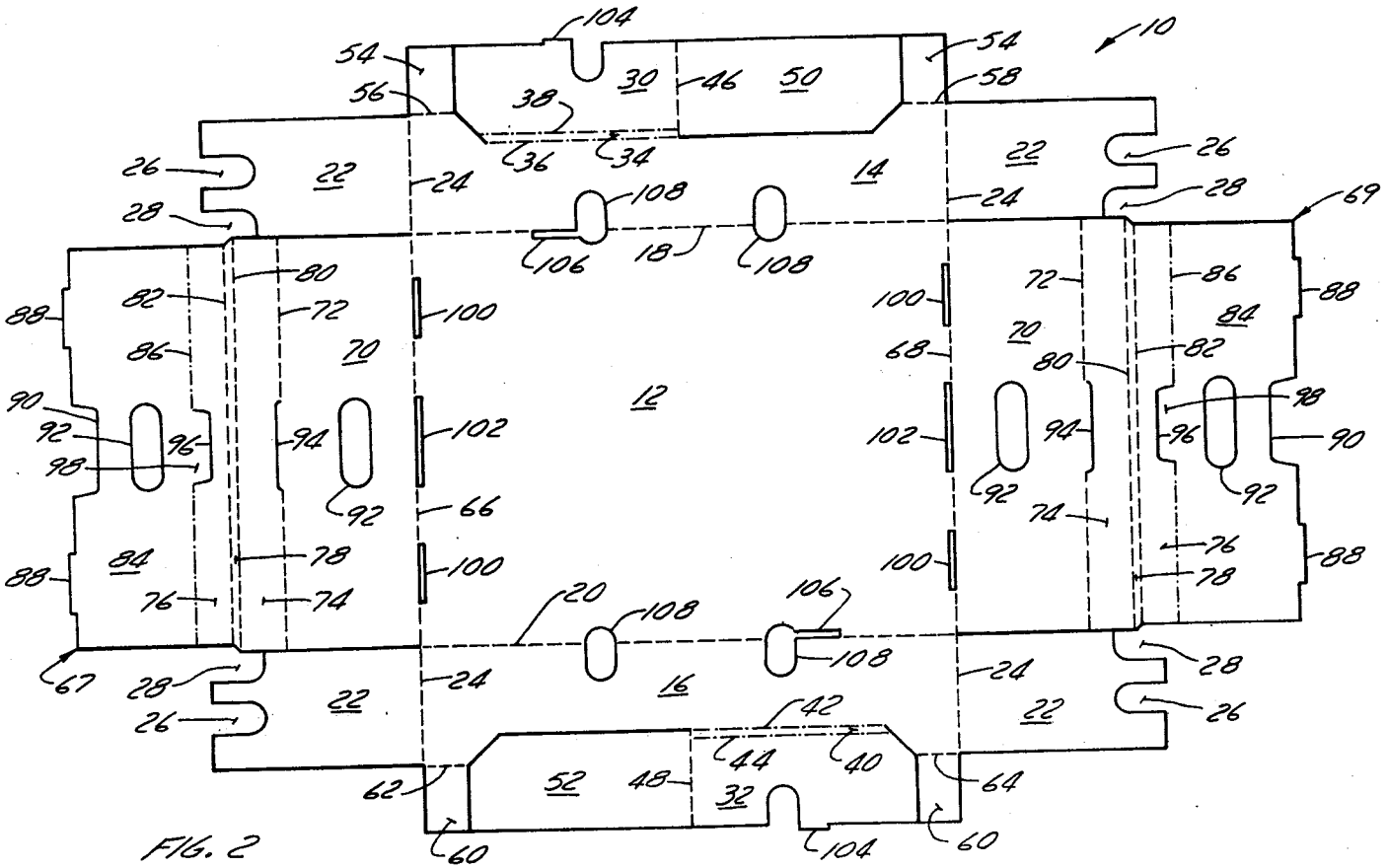
FIG. 2 is a plain view of a blank incorporating the present invention.

Referring to FIG. 2, the blank 10, comprises a bottom wall panel 12 having side wall 14 and 16 connected thereto by fold lines 18 and 20 respectively. End wall flaps 22 are connected to opposite ends on the side walls 14 and 16 by fold lines 24 substantially perpendicular to the fold lines 18 and 20. The free ends of the flaps 22 in the illustrated arrangement are cut out as indicated at 26 and 28 to respectively form hand holes in the end wall and are spaced to accommodate the nesting projection of the tray immediately there below, when erected trays are stacked as will be described more particularly here below.

The side wall panels 14 and 16 are provided respectively with inner side wall forming flaps 30 and 32, positioned one toward each end of the blank. The flap 30 is connected to the wall 14 via connecting panel 34 which in turn is connected to the wall 14 and 30 by fold lines 36 and 38 respectively. The flap 32 is similarly connected to the wall 16 via intermediate or top panel 40 which is connected to the wall 16 and flap 32 via fold lines 42 and 44 respectively.

As above indicated, the flaps 30 and 32 are connected, by fold lines 46 and 48 substantially perpendicular to the fold lines 18 and 20 and positioned at about the center line of the tray, to transverse partition forming flaps 50 and 52 respectively.

A top end flap 54 is connected at each end of the wall 14 via fold lines 56 and 58 and similar top end flaps 60 are connected to opposite ends of the wall 16 via fold lines 62 and 64.

The end wall forming structures at opposite ends of the blank are substantially mirror images and therefore the same reference numerals have to be applied to equivalent parts.

Connected to opposite ends of the bottom wall 12 via fold lines 66 and 68 are end wall forming structures 67 and 69. Directly connected to fold lines 66 and 68 are first end wall forming panels 70 which in turn are connected via fold lines 72 to first top wall panels 74. Top wall panels 74 are connected to the second top wall panels 76 via intermediate panels 78 which are connected to their respective top panels 74 and 76 via fold lines 80 and 82 respectively. A second end wall panel 84 is connected to each of the second top wall panels 76 via a fold line 86 and the panels 84 are provided along their free ends with locking tabs 88 and a cut out 90 for purposes to be described in more detail herein below.

Each of the end wall forming panels 70 and 84 is provided with a cut out 92 adapted to co-operate with the cut outs 26 to form hand holes in the end walls of the erected tray.

It will be noted that the fold line 72 is divided by a cut out section 94 formed in the first top wall 74 and adapted to form an opening in this top wall when the tray is erected. Similarly, the fold lines 86 are divided into two sections via a U shaped cut 96 in the panels 76 which defines a nesting projection 98 on the top edge of the panels 84.

The bottom panel 12 is provided adjacent the fold lines 66 and 68 with cut outs 100 positioned to receive the tabs 88 when the tray is erected whereby the end walls are held in position. Also provided in the bottom wall and positioned one along each of the fold lines 66 and 68 and between the slots 100 are nesting cut outs 102. The nesting cut outs 102 are positioned to receive the nesting projections 98 from a tray position immediately therebelow when a plurality of trays are stacked in nesting relationship.

The inner side wall flaps 30 and 32, are each provided with a projecting tab 104 which is adapted to co-operate with a slot 106 cut in the bottom wall 12. Also formed in the bottom wall 12 and side walls 14 and 16 are drainage cut outs 108 (four illustrated).

To erect a tray from the blank of FIG. 2, the side walls 14 and 16 are folded into a position substantially perpendicular to the bottom wall 12 along fold lines 18 and 20 respectively and the flaps 22 are folded along fold lines 24 into a position substantially perpendicular to the side walls 14 and 16. The end top flaps 54 and 60 are folded along fold lines 56, 58, 62 and 64 into a position substantial perpendicular to the side walls 14 and 16.

Figure 1:
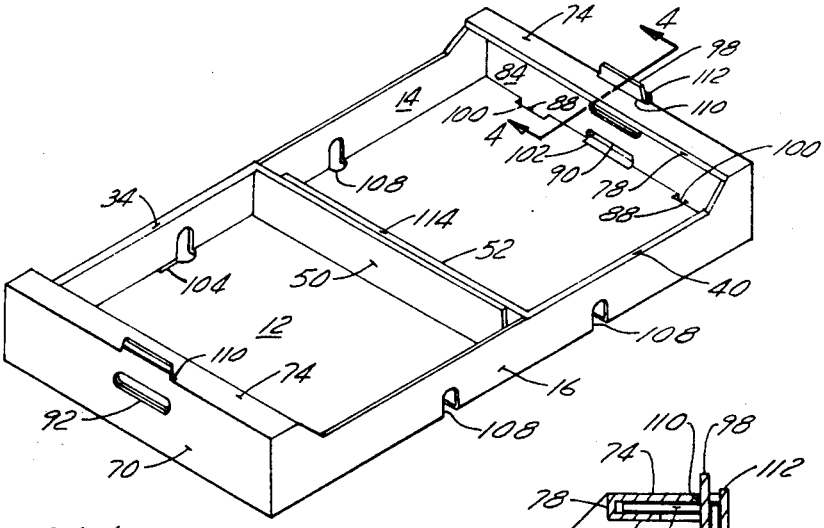
Figure 4:
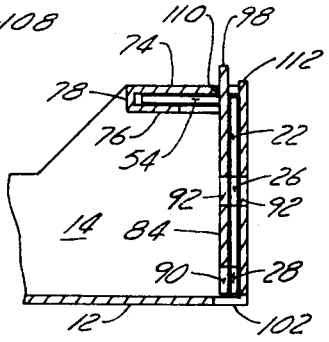
FIG. 4 is a section along the line 4—4 of FIG. 1.
Figure 3:
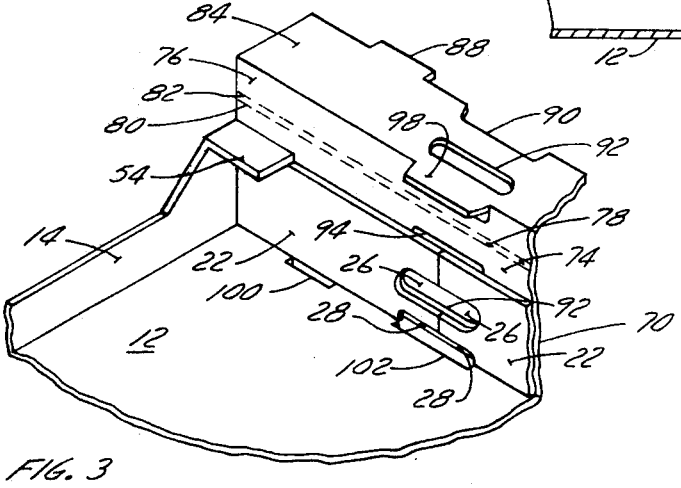
FIG. 3 is a partial isometric view illustrating the folding step in the formation of the tray from the blank of FIG. 2.

After the flaps 22, 54 and 60 have been folded into position, as above described, the end walls may be formed by folding the panels 70 perpendicular to the bottom 12 as illustrated in FIG. 3, folding along fold lines 72, 80, 82 and 86, in a manner to displace slit 94 relative to the top panel 74 and form an opening 110 (see FIGS. 1 and 4) and an upwardly extending projection 112 and then moving the two end top walls 74 and 76 into face-to-face relationship while projecting the nesting projection 98, which breaks from the top wall 76, through the opening 110 to provide the upward extending nesting projection 98 as shown in FIGS. 1 and 4.

The folding of the panels 70, 74, 78, 76 and 84 into position by folding along fold lines 68, 72, 80, 82 and 86 results in the top panels 74 and 76 embracing the top end flaps 54 and 60 extending from the side walls 14 and 16 and the end wall panels 70 and 84 embracing the end wall flaps 22 as shown in FIG. 4. To secure the end walls in erected position the tabs 88 are projected into the slots 100 in the bottom wall, 12 as shown in FIG. 1.

Erection of the side walls may be completed before or after the formation of the end walls, and is attained by folding the flaps 30 and 32 into face-to-face relationship with the walls 14 and 16 by folding along the lines 36, 38 and 40, 44 respectively, and positioning the tabs 104 into the slots 106 in the bottom wall. After the flaps 30 and 32 have been so positioned, the partition flaps 50 and 52 may be folded into a position substantially perpendicular to the flaps 30 and 32 to form the transverse partition 114 as shown in FIG. 1

It will be noted that the panels 70 and 84 together the flaps 22 provide a relatively strong vertical section and that a reinforced platform is provided by the top panels 74 and 76 and interconnecting panel 78 combining with the top end flaps 54 and 60. Thus a reinforced platform the top of which is formed by top panel 74 is provided and is supported by the end wall panels 70 and 84 and the side walls 14 and 16 through the flaps 54, 22 and 60.

The projections 98 extend up through the apertures 110 in the top panels 74 and are received in the openings 102 and the cut out areas 90 and 28 formed in the panels 84 and the flaps 22 respectively in the tray immediately thereabove when the trays are in stacked nested relationship. Thus a relatively secure and nested structure is provided when a plurality of trays constructed in accordance with the present invention are piled one on top of the other.

Modifications may be made without departing from the spirit of the invention as defined in the appended claims. For example, the side walls 14 and 16 may be directly connected to the inner side flaps 30 and 32 respectively without requiring the intermediate top wall 40. Similarly the two top walls, 74 and 76, may be connected directly without the interpose connecting wall, 78, by providing appropriate folding structures are provided to replace in these walls 40 and 78.

I claim:

1. A blank and tray formed therefrom comprising a bottom wall, side walls foldably connected along opposite sides of said bottom wall by a first pair of substantially parallel fold lines, and flaps connected to opposite ends of each of said side walls by fold lines substantially perpendicular to said first pair of fold lines, end wall structures foldably connected to opposite ends of said bottom wall by a second pair of fold lines substantially perpendicular to said first pair of fold lines, each of said end wall structures including a first end panel foldably connected to said bottom panel, a first top panel, a second top panel and a second end panel foldably interconnected by a set of fold lines substantially perpendicular to said first set of fold lines, a nesting panel formed from said second top panel and connected to said second end panel, a slot through said first top panel adjacent the connection of said first top panel with said first end panel, said slot and said nesting panel being positioned in a manner that said nesting panel may be projected through said slot when said blank is erected to form said tray.

2. A blank and tray constructed therefrom as described in claim 1 further comprising top end flaps foldably connected to the top of each side wall adjacent each end of said side walls, on fold lines substantially parallel to said first pair of fold lines.

3. A tray comprising a bottom wall, side walls connected to opposite sides of said bottom wall and extending substantially perpendicularly thereto, end flaps at opposite ends of each of said side walls and projecting substantially perpendicularly to said side walls, to end flaps foldably connected to the top of each side wall adjacent each end of said tray and extending substantially perpendicular to said side walls and said end flaps, end wall structures foldably connected one to each end of said bottom wall, each of said end wall structures including a first end panel lying in face-to-face relationship with one face of a pair of said flaps at one end of said tray, a first top panel extending substantially perpendicularly to said first end panel, a second top panel in substantially face-to-face relationship with said first top panel, a second end panel in face-to-face relationship with the face of said flaps opposite said one face, means for securing said end structures in erected position wherein said first and second end panels embrace said end flaps and said first and second top panels embrace said top end flaps at each end of said tray, said first end panel, said first top panel, said second top panel and said second end panel being foldably interconnected by a set of substantially parallel fold lines, a nesting panel formed in said second top panel and connected to said second end panel, said nesting panel projecting from said second end panel through an aperture in said first top panel, said bottom wall, said second end panel and said end flaps being cut out to receive a nesting panel projecting from a tray positioned immediately therebelow when a plurality of said trays are stacked one on top of the other.

4. A tray as defined in claim 3 further comprising an interconnecting wall interposed between said first and second top walls.

* * * * *